US005947788A

United States Patent [19]

Derrah

[11] Patent Number: 5,947,788

[45] Date of Patent: Sep. 7, 1999

[54] RADIO CONTROLLED SURFBOARD WITH ROBOT

[76] Inventor: Steven J. Derrah, 726 Park Ave., #6, Portsmouth, R.I. 02871

[21] Appl. No.: 08/918,413

[22] Filed: Aug. 26, 1997

[51] Int. Cl.[6] ..... A63H 23/06; A63H 13/00; B63H 25/00; B63H 43/02

[52] U.S. Cl. ..... 446/154; 446/163; 446/326; 446/354; 114/144 A; 114/360; 114/270

[58] Field of Search ..... 446/153, 154, 446/156, 160, 163, 164, 325, 326, 275, 351, 353, 354; 114/144 A, 360, 270

[56] References Cited

U.S. PATENT DOCUMENTS

| | | | |
|---|---|---|---|
| 3,765,362 | 10/1973 | Gitchel | 114/144 A |
| 3,793,761 | 2/1974 | Bonham | 446/154 |
| 4,270,307 | 6/1981 | Arigaya | 446/154 |
| 4,551,113 | 11/1985 | Sugihara | 446/154 |
| 4,836,820 | 6/1989 | Ebihara et al. | 446/289 |
| 4,923,427 | 5/1990 | Roland | 446/153 |
| 4,971,586 | 11/1990 | Walsh | 440/88 |
| 5,582,529 | 12/1996 | Montgomery | 441/74 |

FOREIGN PATENT DOCUMENTS

| | | | |
|---|---|---|---|
| 125984 | 6/1987 | Japan | 114/360 |
| 2208628 | 4/1989 | United Kingdom | 114/360 |

*Primary Examiner*—Robert A. Hafer
*Assistant Examiner*—Laura Fossum
*Attorney, Agent, or Firm*—Cristina M Offenberg

[57] ABSTRACT

A radio controlled surfing toy is provided comprising a multi-jointed, moveable figurine pivotally attached to a jet-propelled surfboard. The surfing toy surfs similar to a real life surfing professional in waves ranging from 3" to 5' in height. The surfing toy is capable of fielding and catching waves on its own and riding a left or right breaking wave into the shore operating on a synchronized 4-way steering system controlling the figurine's body to move from one side of the board to the other and allowing dramatic realism and high performance surf stunts. A balloon recovery system is employed to right the surfboard after a wipe-out in conjunction with a righting mechanisms built-in to the surfboard's design.

18 Claims, 8 Drawing Sheets

FIG. 1
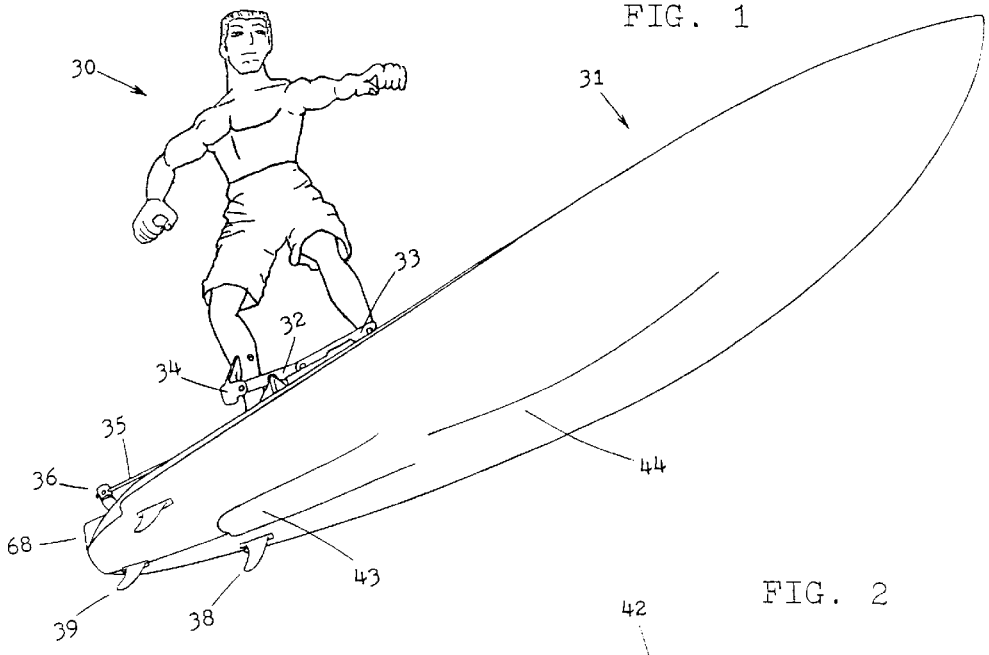
FIG. 2
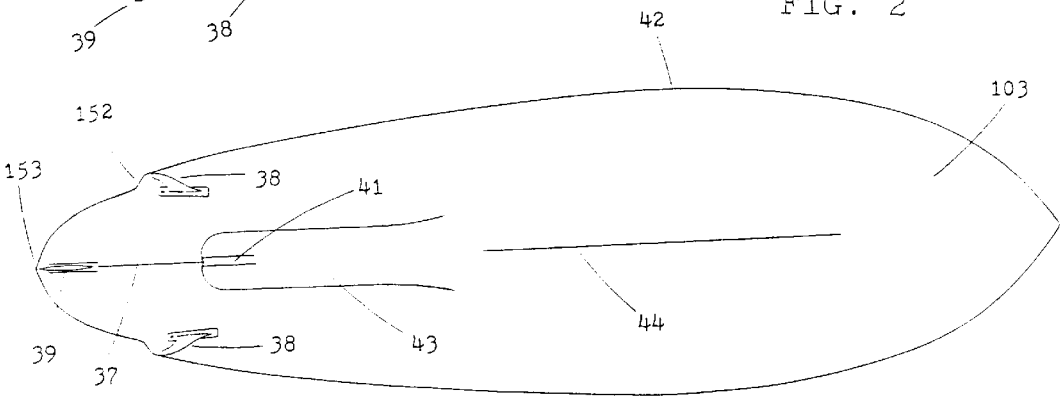
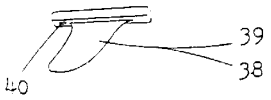
FIG. 2A

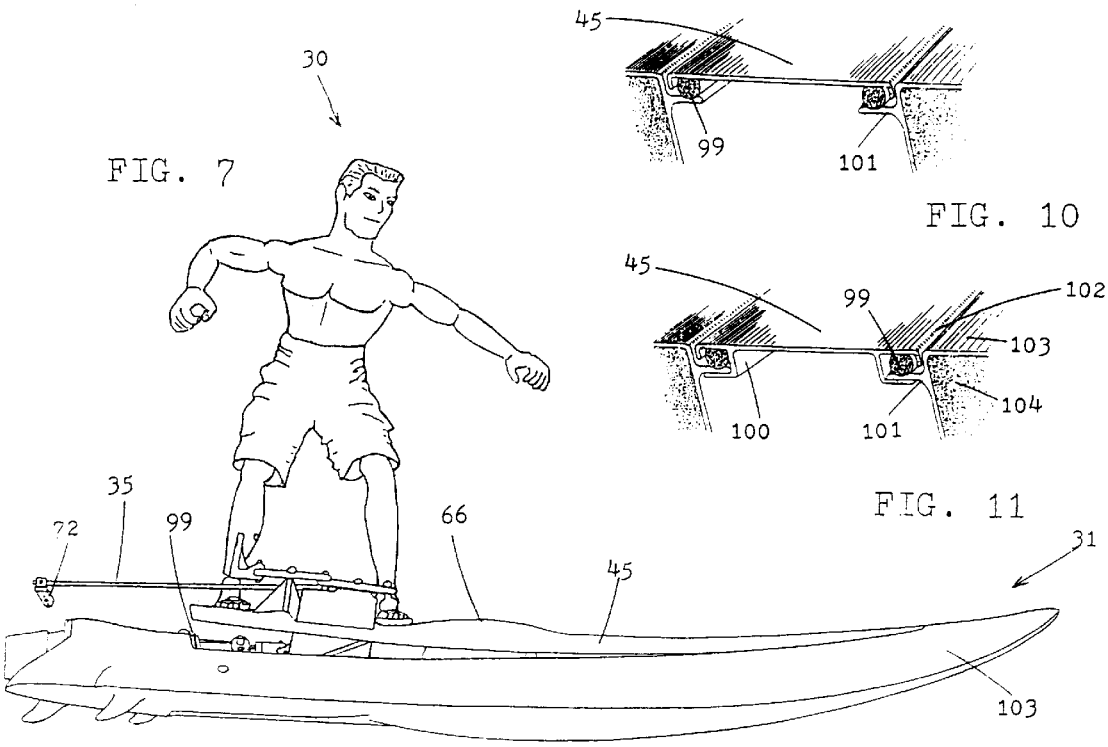
FIG. 7
FIG. 10
FIG. 11
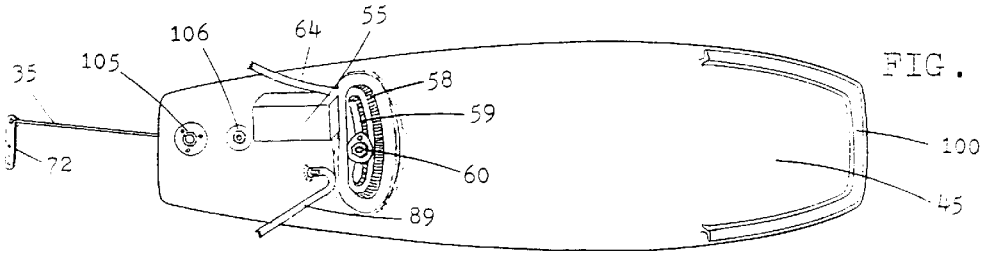
FIG. 8
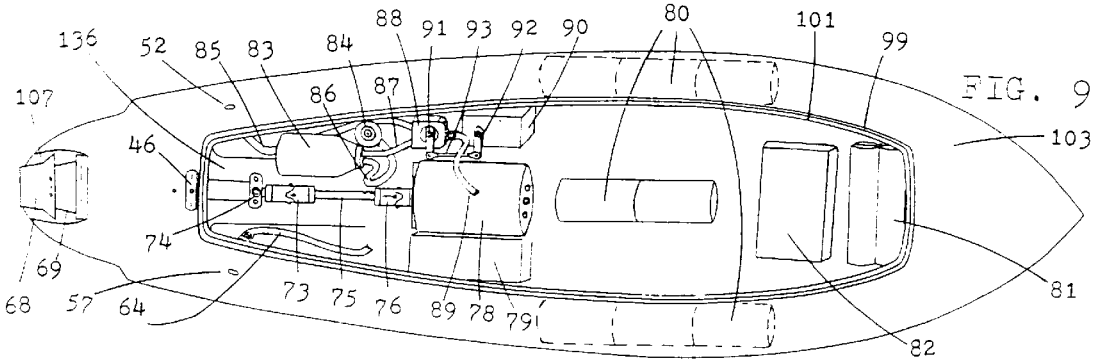
FIG. 9

FIG. 25
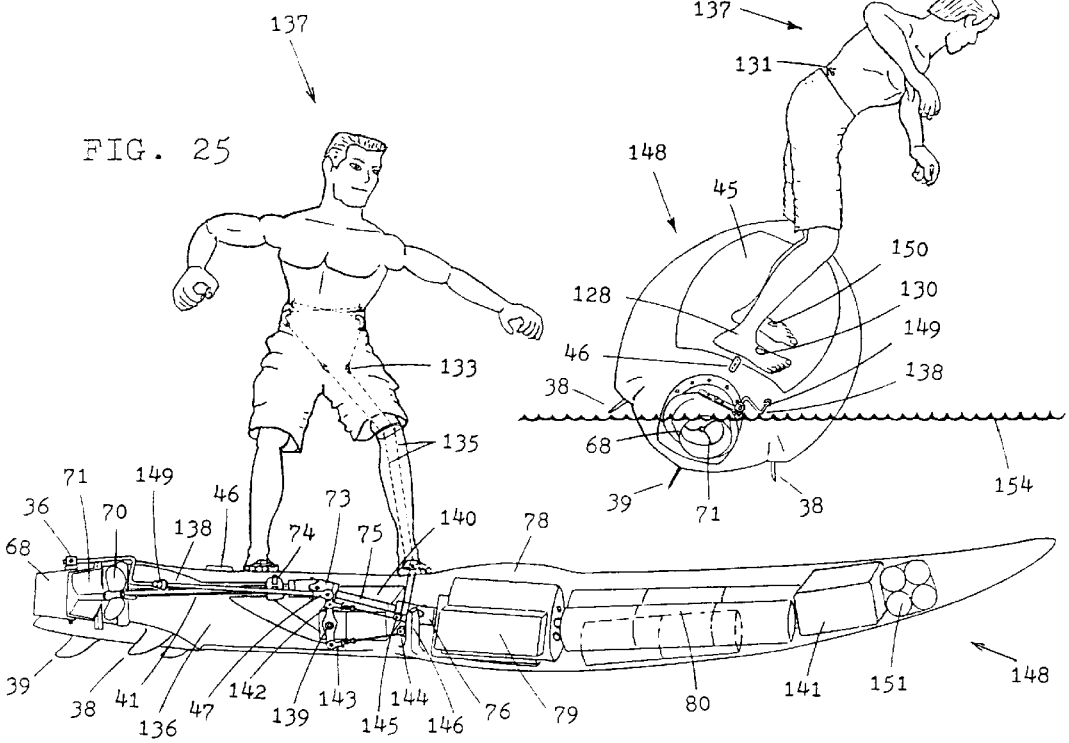
FIG. 26
FIG. 27
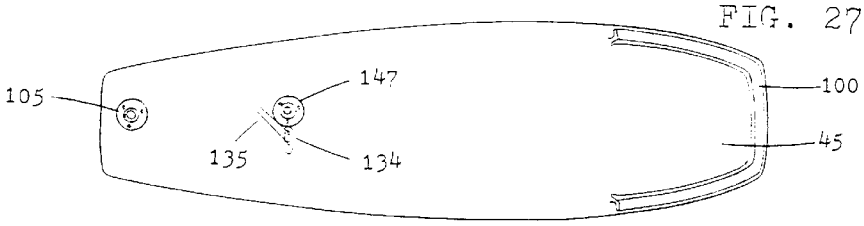
FIG. 28
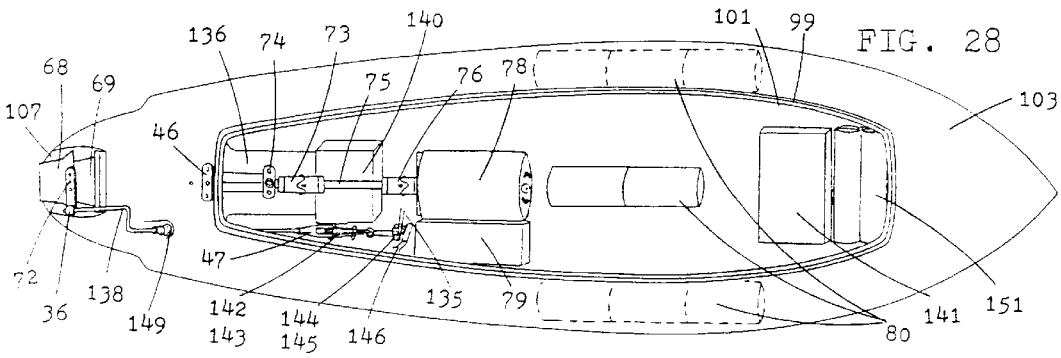

RADIO CONTROLLED SURFBOARD WITH ROBOT

BACKGROUND OF THE INVENTION

1. Field of Invention

The present invention relates to a radio controlled, jet propelled, surfing robot construction in the nature of a toy or amusement device.

2. Background of the Invention —Description of Related Art

Various types of boats and surfboards are known. Radio controlled toy boats and self propelled full-scale surfboards are also known and toy surfboards that can be picked up by cresting waves or pushed into breaking wave faces by human hand are also known and come complete with rigid figures aboard. But the prior art surfing figurines cannot actually "surf" a wave at least not at the pace of the true meaning of the modern sport of surfing.

The prior art boards with surfing figurines are taken into the water by a person wading or swimming out of the strike zone. The user pushes the surfing figurine into a large cresting wave and watches as the surfing figurine goes straight down the unbroken face of the wave. When the wave breaks the surfing figurine "rides" the white water for the rest of the distance straight in to the shore. Any piece of drift wood would react in the same way. It is not the way a person surfs a wave or the way the subject invention surfs a wave.

The patent literature is replete with patents describing toy boats and among them is the design patent of Reuther (Pat. No. Des. 168,807) which shows a self-propelled double hulled toy with a figurine standing thereon. It cannot surf because it is double hulled and will tip over with the curling force of the wave. Also, later design patents relating to motorized surfboards illustrated in the patent of Levenson (Pat. No. Des. 205,254) and of Bloomingdale (Pat. No. Des. 209,433) show the idea that a human may be able to motor around and catch waves without the physical strain of paddling. These old designs cannot perform modern surfing maneuvers and most importantly are not toys. Also, they do not allow for any mechanisms to steer them or to right themselves when the surfboard wipes-out.

The prior art shown in the Roland patent (U.S. Pat. No. 4,923,427) outlines a toy that has a figurine standing on a surfboard. That is where the similarities end. The Roland invention surfboard cannot ride a wave like a real surfer would on a planing hull surfboard mainly because of the large sailboard keel controlling the righting moment of this toy. This toy relies on the keel to maintain upright mobility even when it gets knocked down by white water. That is where it got its nickname "surf-Bob" cause it bobs up like a buoy. The figurine is immoveable and as light as air so as not to interfere with the keel's dominating effect. But all the emphases put into this toy in order to right itself has taken away its ability to surf. If a sail was installed on it instead of the figurine, it would work better as a toy sailboat than a surfboard. Also, even if this surfing figurine had radio control power and a steering mechanism, it could never ride a wave properly with the sailboat keel. The sailboat keel thwarts maneuverability. The Roland surfing figurine works to surf as if every wave is a closeout. It does not matter if the wave is a perfect peeling left or right; it goes straight anyway. Therefore, it is not "surfing" in the true sense of the term.

The prior art surfing figurines are not directly comparable to the present invention, the ROBOT SURFER. First, the prior art surfing figurine does not do enough to inspire excitement or interest to sell for more than $5.00. The cost for different models of the ROBOT SURFER would range between $200.00 and $1000.00 as it is a high performance, unprecedented surfing device. The ROBOT SURFER is good enough to spawn an entire industry, as well as a competitive sport. Secondly, the prior art toys do not disclose a toy that can actually surf a wave by catching a wave and cutting left or right to stay in the face of the wave, turning from bottom to top gaining momentum from the energy pocket of the wave as the present invention discloses. Lastly, the ROBOT SURFER is an enjoyable pastime that allows the operator to ride waves ranging from three inches to five feet in height.

Months of trial and error testing of many different prototype surfboards and design combinations has resulted in what will soon be obvious to the radio control and mass toy market that the following art outlining the custom surfboard and robot show the best way to make a nicad battery powered surfing toy which can run for twenty minutes before recharging and achieve a high degree of surfing performance. This Robot Surfer is the result of a combination of known surfboard designs, known boat designs, known action figure designs, known radio control and propulsion devices, as well as, may original designs to result in a brand new unprecedented surfing device.

BRIEF SUMMARY OF THE INVENTION

The modern sport of surfing means a person maneuvers his board to the strike-zone where the waves are breaking, then the person goes after a steepening swell and increases his speed by paddling faster in order to drop into the chosen wave. Once in the wave, the object is for board and rider to cut left or right to stay in the unbroken part, or 'face' of the wave, turning from bottom to top gaining momentum from the energy pocket of the wave speeding way out in front then cutting back to the pocket for more energy. The rider maintains a proper wave position the entire time by dancing on top of or around the broken part of the wave or 'white water' but never in front of the white water because once a surfer is at the bottom of the white water the ride is over.

Surfboards are planing hulls that are able to make turns because of an interaction between the rider's weight and the outline shape and tail fins. This is how it works: when a real modern surfer maneuvers to make a right-hand turn, the rider leans his weight over the right side of the board and immediately the widest point of the board acts as a pivot point from where the turn is initiated. The narrower tapered part aft of the board naturally follows and starts to spin around clockwise but then is caught by the tail fins which hold the board in and allow it to track in different radius controlled turns.

In the last 30 years of surfboard designing and evolution the wide points of surfboards have shown up on all different parts of the board. In the 60's, the boards were very long and the wide point was subtle and placed in the middle but had a radical taper way aft which caused the rider to walk backward in order to apply weight over the tapered part of the board to turn in the desired direction, and then walk forward to plane the board out and ride for a distance in that direction.

In the 70's and 80's, the boards were designed shorter and the wide points were placed forward of the rider with a pronounced taper stretching past the rider in a relatively straight line toward a narrow tail. This allowed a rider to stand in one place to make turns.

In the 90's the latest thing in surfboard design is a really short no-nose board. The boards of the 90's are quick-turning boards and have the wide point placed right between the rider's legs, thereby putting the maximum planing surface right where the most weight needs to be supported and allows the rider to maneuver over a dual direction taper. However, this design could not work with the Robert Surfer because of the mass of weight on board this component laden vehicle.

The traditional surfboard designs are used to make the surfing toy of the subject invention. The robot surfer is meant to resemble the actions of a real surfer. It is meant to maneuver and style like a modern day surfer. In addition, it is an intention of the inventor to create a few moves from a futuristic "moto-surfer". With all this in consideration and knowing that a battery powered, radio controlled surfing toy would have to carry a lot more weight on board than a "to-scale" non-powered board and rider, it was discovered that the wide point forward was necessary, similar to the boards made in the 1970's and 1980's.

BRIEF DESCRIPTION OF DRAWINGS

FIG. 1 Is a right side view of the bottom of the custom board and robot.

FIG. 2 Is an overhead view of the bottom of the surfboard hull.

FIG. 2*a* Is a close up view of the snap fit break away fins.

FIG. 7 Is a right side view of the custom surfboard and robot with the waterproof deck partially open.

FIG. 8 Is an overhead view of the underside of the waterproof deck of the custom surfboard.

FIG. 9 Is an overhead view of the custom surfboard with the waterproof deck detached.

FIG. 10 Is a sectional view of the waterproof deck closed over the neoprene gasket and ledge.

FIG. 11 Is a sectional view of the waterproof deck clamped over the neoprene gasket and ledge by the compression cuff.

FIG. 25 Is a right side cutaway view of the mass market surfboard and robot.

FIG. 26 Is an elevated end view of the mass market surfboard and robot in a full extension right-hand turn showing lean angle to the waterline.

FIG. 27 Is an overhead view of the underside of the waterproof deck of the mass market surfboard.

FIG. 28 Is an overhead view of the mass market surfboard with the waterproof deck detached.

DETAILED DESCRIPTION OF THE INVENTION

Figure 3:
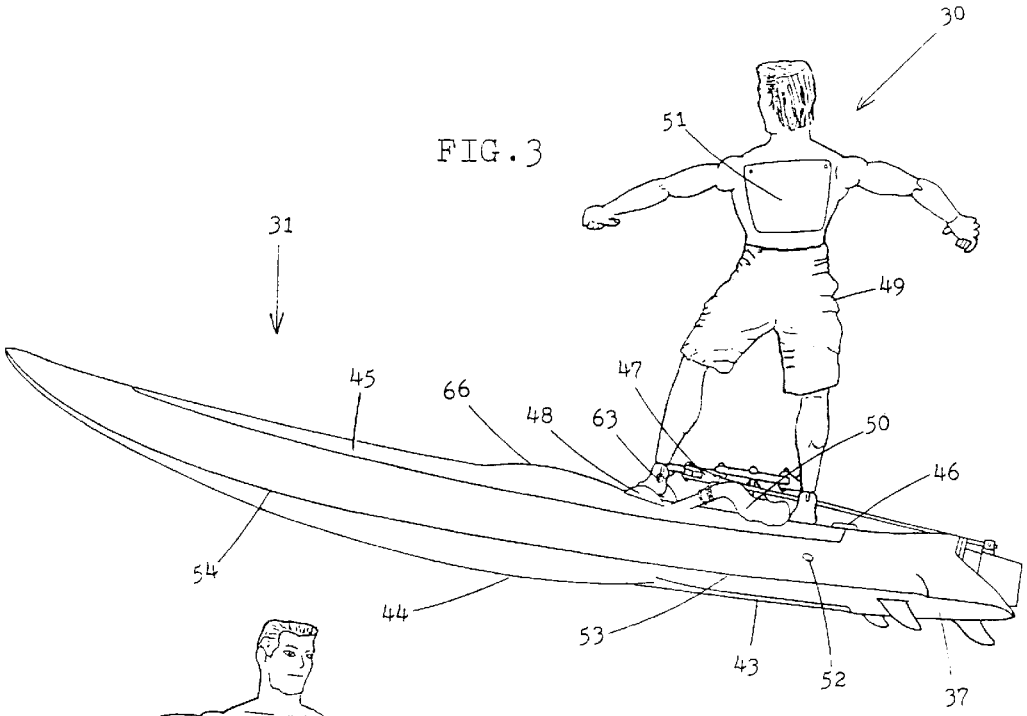
FIG. 3 Is a left side view of the custom surfboard and robot.

Two embodiments of the present invention are described. First is the Custom Design which allows for more control and maneuverability. Second is the Mass Market Design which can be made at a decreased cost than the Custom Design, but is made to have less maneuverability.

The electrical connections or wires are not shown in any drawings. It is assumed that all parts are connected to each other by the proper wiring provided with each component. It would be too confusing to clearly see the many components in a drawing with wires running everywhere in between.

FIG. 1 shows the custom robot (30) which is fixed standing on the custom board (31) in a sideways surfer stance with the board's center line running straight under the forward part the ankles of the custom robot (30). The custom robot's (30) standing position is critical in relation to the shape and weighted areas of the surfboard. The elongated opening on the bottom of the custom board (31) is the suction hole (43) which due to its large diameter and longitudinal mounting angle makes for a hole in the bottom of the custom surfboard that measures between a range of 7% and 14% of the entire bottom surface and ranges between 20% and 30% of the wetted bottom surface of the surfboard when running. The oversized suction hole (43) combined with an oversized impeller (70) and housing (136) sucks the surface of the surfboard to the water's surface; and enables the custom board (31) and custom robot (30) to do incredible stunts and maneuvers. However, as more power is applied, the custom board (31) and custom robot (30) become more stable and is used when motoring out against incoming surf. It decreases the chances of a knockdown. The suction to the water's surface is a deterrent to steering in a tight radius and lessens the robot's ability to lean over to its maximum degree. Thus the steering nozzle (68) is necessary. When the custom board (31) and custom robot (30) are surfing a wave or traveling at low speeds, the robot's body movements alone are sufficient to steer the board. However, when the power is on high and traveling at speeds more than 20 mph, the positive direction changes offered by the steering nozzle (68) are necessary to handle the inertia created by the high flow of water traveling through the suction tube housing (136). This high flow of water causes the custom board (31) and custom robot (30) to stand straight up and head straight forward. The steer nozzle (68) is necessary to make directional changes at 20 mph, to range for waves, or to maneuver between heavy breakers.

FIG. 2 shows the V-bottom (44) and (37) of the board which helps the turning efficiency by increasing side to side rocking and adds stability in choppy waters. The V-bottom (44) and (37), also increases volume inside the surfboard hull (103), which allows space for the many components. Also shown are the tail wings (152), the rounded pintail (153), the side fins (38), and the center fin (39), which give the board more "bite" and thereby enabling it to track through turns with precision and without side slipping. The side fins (38) are mounted just forward of the tail wings (152) near both left and right sides of the board. They are also set at a 90 degree angle to the aft V-bottom surface (37). The center fin (39) is mounted just forward of the rounded pintail (153) on the centerline of the surfboard hull (103) and is set at a 90-degree angle to an imaginary flat plane that is even with the bottom.

FIG. 2*a* shows the center fin (39), and side fins (38) which are designed to break away when hit by something. The ability to break away saves the bottom of the surfboard hull from being ripped off with the fins in the event of a rock ride or an abrupt shore landing. The fins (39) and (38) snap fit in and out and come with a pry hole (40) to extract the remaining fin base from the undamaged fin box (not shown) to make way for a replacement. The fins (38) and (39) are desirably molded out of a semi-brittle plastic with the fin body being thin yet foiled from edge to edge. Also, a pack of replacement fins should be included with each board and robot in three different sizes to create different turning effects.

FIG. 3 shows how the soft shape of the rails (54) forward and the sharp edges (53) aft work in conjunction with the tail wing (152), the rounded pintail (153), the side fins (38), and the center fin (39) [as shown is FIG. 2] to plane-out the board and robot when under power. The rails (53) and (54) are down-turned and sharp edged (53) toward the aft end of the surfboard hull (103). The soft-edged rails forward (54) are designed to be round so as not to catch or dig in and track. The design of the rails help the board and robot's waterline to change from enveloping the board up to the waterproof deck seam (45) when treading water at a full stop and then to having the water flow under the rail line at speeds of five miles per hour or less.

Figure 4:
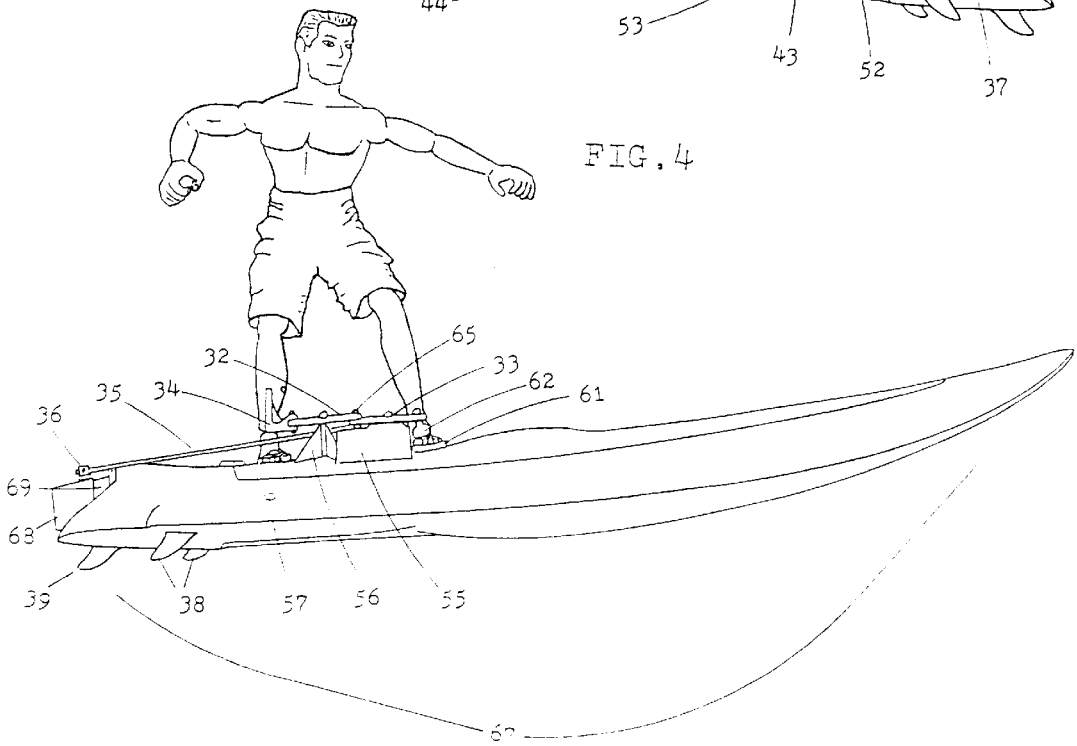
FIG. 4 Is a right side view of the custom surfboard and robot.

FIG. 4 shows the continuous nose to tail rocker (67) which is essential in turning on a wave as it contours to the curvy angles of the waves through sucking up the wave's face. Also shown is a side view of these important parts. It shows the primary waterproof servo (55) connected to the 3-way servo arm (33) which connects to the foot travelers 2-way connector (62). It also shows how the opposite end of the 3-way servo arm (33) connects to the reversing arm (32) by the urethane connector pin (65). This pin is flexible so that the primary servo (55) can reach its full rotation travel and to provide snap-back in the opposite direction giving the custom board (31) and custom robot (30) a realistic and functional pumping motion when turning back and forth. The turning sensation is heightened by the flexible nature of the reversing arm (32). Also shown is the lean stand (34) connected to the reversing arm (32) and then to the robot's shin. The upper part of the lean stand (34) fits into a slot cut out of the robot's upper shin. A through bolt is used to hold the pin in and allows it to pivot. The slot is cut tight to the sides of the lean stand (34) so it cannot twist. The lower part of the lean stand (34) connects to the reversing arm (32) with a single bolt and nut that allows it to swivel which is necessary to take up the robot's shin coming down and across. [It is called a lean stand because it is the connector that makes the robot lean over and it is also a holder that stands the robot upright].

Figure 5:
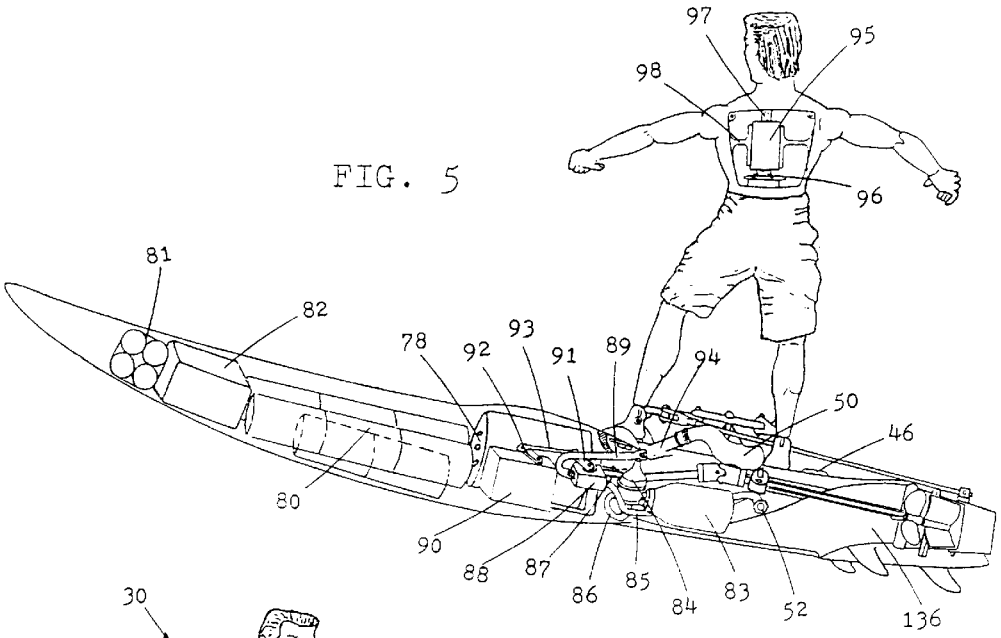
FIG. 5 Is a left side cutaway view of the custom surfboard and robot.

FIG. 5 shows a cutaway view revealing components inside the hull and also shows the weighted areas of the surfboard hull which are critical in balancing out the many component weights on board this custom board. For instance, the jet suction tube (136) is aft and tends to raise the bow when the throttle is "on". In order to keep the bow down, the motor (78) the batteries (80)(81), the speed control (79), and the receiver (82) are all placed in front of the robot (30). Also the motor batteries (80) are place in a tri-plex arrangement to provide a righting moment as well as a low center of gravity. The four servo and receiver batteries (81) are seen mounted way forward next to the 3-channel receiver inside a metal box (82) that helps insulate the receiver from motor noise and vibration which can interfere with the signal and cause glitching. The capacitor insulated 9.6 volt electric motor (78) can also be seen behind the recovery servo (90) which runs the carbon dioxide three-way valve (88) by way of the servo arm (92), push rod (93), and the valve arm (91). This carbon dioxide three-way valve (88) fills the balloon (50), deflates the balloon (50), as well as, shuts closed without leakage as indicated on the control box's face [shown in FIG. 20]. The carbon dioxide holding tank (83) is seen next to the carbon dioxide filler cap (84) which refills the carbon dioxide tank (83) (after it is emptied by filling the recovery balloon (50) approximately three times). The carbon dioxide exit hole (52) is also shown where the balloon air is exhausted when the balloon is deflated. The balloon neck (94) is seen outside the surfboard deck which allows the recovery balloon (50) to be clamped air tight. [All of these aforementioned parts can be seen from a top view in FIG. 9].

Figure 6:
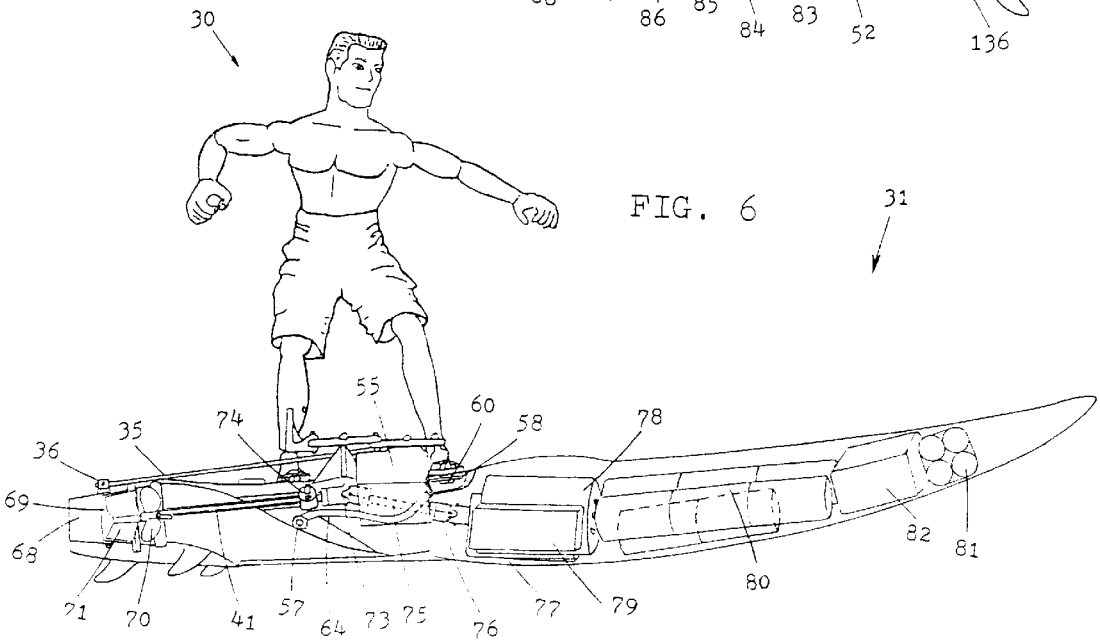
FIG. 6 Is a right side cutaway view of the custom surfboard and robot.
Figure 12:
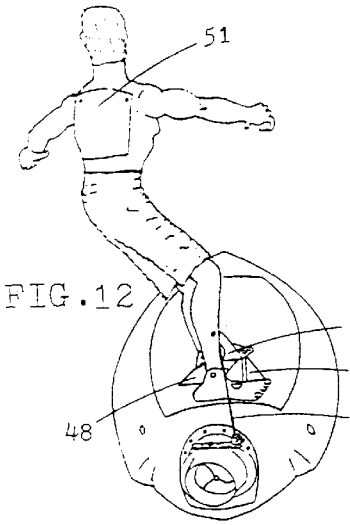
FIG. 12 Is an elevated end view of the custom surfboard and robot in the full extension left-hand turn position.
Figure 13:
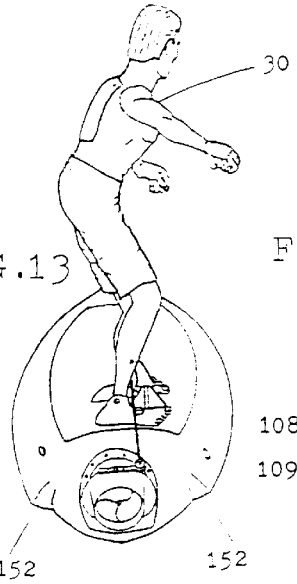
FIG. 13 Is an elevated end view of the custom surfboard and robot in the center balanced go-strait position.

FIG. 6 displays many of the same parts as FIG. 5, however, it is a right side view and shows the drive train and foot traveler components more clearly as well as the electronic speed control (79). The drive train (starting from the motor) is comprised of the lower universal (76) connected to the motor at the 40 mm bridge shaft (75) which travels upward to the upper universal (73) which connects to the drive shaft and stuffing-box (41) which has a grease nipple (74) which allows the stuffing-box to be filled so the water does not flush inside the surfboard hull (103). The shaft and stuffing-box (41)extends into the impeller (70) which spins to propel the board and robot at more than twenty miles per hour. Just behind the impeller (70) is the guide vane (71) which sits inside the thrust nozzle (69). This straightens out the swirl from the impeller that would otherwise make the board favor turning to one side. Connected to this is the steering nozzle (68) which directs the flow of water coming out of the guide vane (71) and thrust nozzle (69).

FIG. 7 shows the right side view of the custom board (31) and custom robot (30) with the waterproof deck (45) molded in an excessive curve so it applies even pressure to the neoprene casket (99) for the length of the deck when it is closed and clamped to fit flush to the shape of the surfboard (31). The detachable waterproof deck is comprised of fitted panel fitting flush to the shape of the surfboard. The deck is easily fastened with one pivoting deck clamp. The construction of the deck is made possible through the unique design of the compression cuff, which slides into place and is held fast due to the overview outline shape of the forward part of the deck. The combination of the cuff, the decks outline shape, and the unique molded-in curve allows even pressure to be applied to the entire length of the deck to prevent water from entering the engine room. The water proof deck as designed and being fastened by only one fastener is unprecedented in the remote control market as well as the jet ski and motor surfing markets.

FIG. 8 shows the underside of the foot traveler well (58) with the cover off (not shown), as well as, the travel groove (59) and the custom blind nut and guide pin (60) also the well drain tube (64). The bottom of the primary servo (55) is seen next to the reversing arm bolt nut and washer (106). Near this is the rear foot blind nut (105) and the push rod (35) and the detached steering arm (72).

FIG. 9 is a top view of the custom board (31) with a waterproof deck (45) that is detached showing an overhead view of all components. It shows a top view of the deck clamp (46) in the open-deck position [see FIG. 18 for an end view of the shut position and see FIG. 3 for a left side view of the shut position of the deck clamp]. It has male and female positioning points to lock it in open or shut positions. [See FIG. 7 for the side view of the detached snap-fit steering arm(72) which has to be undone to remove the waterproof deck and robot and see FIG. 8 for an underside top view of the compression cuff]. This figure shows the triplex arrangement of the nicad batteries (80). It is preferable to place the larger triple motor battery packs (80) at the edges of the hull as far apart from the center line of the hull as possible. In spreading the motor battery packs to the edges of the hull, the surfboard vehicle has a built in righting moment due to the weight of these batteries, the weight of the double battery pack (80, and the weight of the 9.6 volt motor located deep in the v-bottom at the center of the hull. The foam construction is hollowed out where the triple battery packs are located. This makes the component cabin large with much vacant space and foam strips (not shown here) should be placed in these vacant areas to keep the board and robot from sinking to the bottom if a massive leak should occur.

FIG 10 shows a sectional view of the waterproof deck (95) closed over the neoprene gasket (99) and ledge (101). [See FIG. 7 for a side view and FIG. 9 for a top view].

FIG 11 is a sectional view of the waterproof deck (45) clamped over the neoprene gasket (99) and ledge (101) by the compression cuff (100). The compression cuff (100) compresses the forward one-third of the waterproof deck (45) and keeps it in place to fit into the gasket ledge (101) for the remaining two-thirds of the length of the waterproof deck (45). Also shown is the down-turned deck edge which adds rigidity to the waterproof deck (45) and is nonexistent at the bow edge and at the tail edge. (Not shown). The foam core (104) which fills the outer skin of the surf board hull (103) is shown.

FIGS. 12, 13, 14, 15, 16, and 17 show the robot's standing position. The standing position is critical in relation to the shape and weighted areas of the custom board (31). For instance, the robot stands behind the widest point of the surfboard yet in front of the tail wings (152). This way, the robot's weight is distributed over a narrower part of the board where the robot's weight and movements have more effect while allowing the turns to be initiated from in front of the robot at the surfboard's widest point (42) to give stability from a constant point of control. Also, the wings (152) behind the robot give the effect of the board turning like a shorter surfboard and thereby allowing a tighter turning radius.

Figure 18:
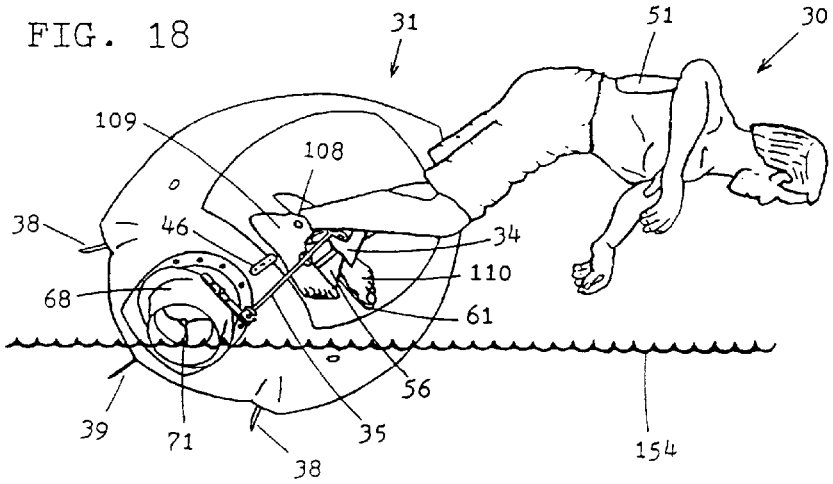
FIG. 18 Is an elevated end view of the custom surfboard and robot in the full extension right-hand turn position showing lean angle to the waterline.

FIG. 18 shows the custom board (31) and custom robot (30) in a full extension right-hand turn with the board (31) at a 45-degree angle to the water line (154) and the robot (30) parallel to the waterline (154). This drawing shows the radical turning capabilities of this invention. The custom board (31) and custom robot (30) are able to turn in some very tight radiuses. At the apex of a turn is where the board is at a 45-degree angle to the waterline (154) and the robot's upper body is parallel to the waterline. This extreme turning capability is made possible by three synchronized body movements performed by the custom robot (30) that work in sync with the steering nozzle (68).

Figure 19A:
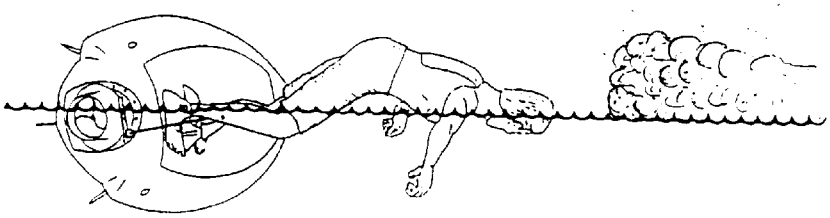
FIG. 19*a* Is an end view of the custom surfboard and robot showing the robot floating just before an oncoming wave of white water rights the board and robot.

FIG. 19*a* shows how the custom board (31) and the mass market board (148) can be righted by oncoming waves due to the tri-plex arrangement of the eight 1500 megahertz nicad motor batteries (80) (also shown in FIGS. 5, 6, 9, 25, and 28). These batteries make up most of the built-in righting moment in both the custom board (31) and mass market board (148). The two other cell packs contain three 1500 megahertz batteries each. These packs are the single heaviest components inside the surfboard hull (103). Placing these batteries as close to the running surface as possible, as well as, and more importantly, spreading them apart towards the sides of the board at its widest point makes the board very unwilling to stay on its side. This means that the width of the board is set vertically with one battery pack on top of the other and a wide space between them. Gravity causes the board to be brought to a horizontal position. The combination of the remaining double 1500 megahertz battery pack (80) placed at the lowest point of the v-bottom of the hull (103) and the 9.6 volt electric motor (78) allows for gravity to favor turning the board towards its bottom after falling to its horizontal position. The robot's foam filled, floating body acts as an outrigger keeping the board from laying horizontally upside down when knocked over by a wave. This sets up a scenario where just about any movement would favor the board to tip towards its bottom and, in turn, right itself. A foam life jacket (not shown here) can be placed on the robot for increased floating ability. Additionally, the custom robot (30) can use its body movements to rock back and forth and eventually jerk itself to an upright position. However this righting method takes more time than using the natural waves action for righting. The mass market board (148) and robot (137) can right itself by running in a circle until it is at the correct angle in relation to the oncoming waves which will push the robot into an upright position. The operator then accelerates at just the right instant while the board and robot are in an upright position. The operator can then cause the board to motor and range more waves.

Figure 19:
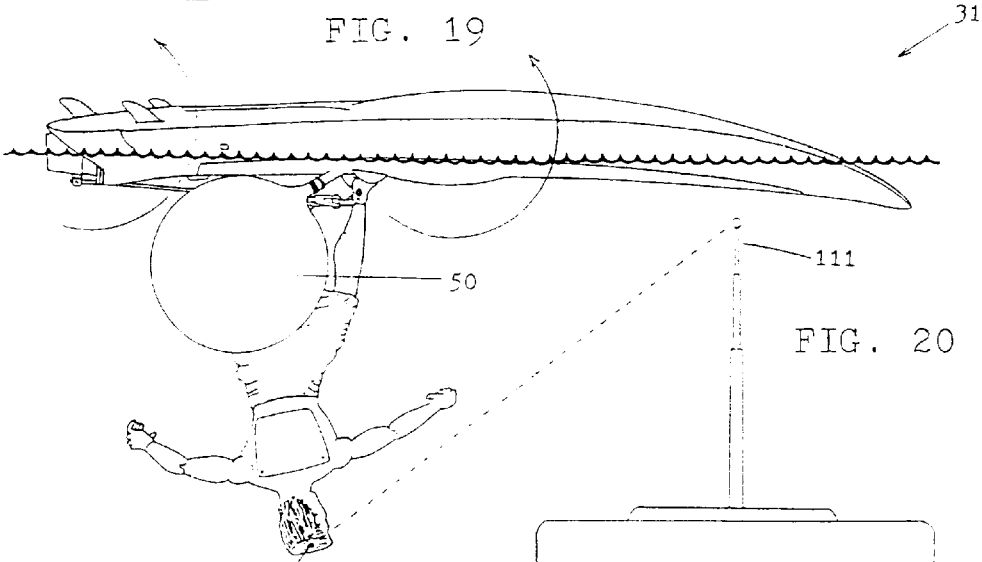
FIG. 19 Is a side view of the custom surfboard and robot upside down after a knock down in a severe white water swirl showing the recovery balloon inflated just before it rights the board and robot.

FIG. 19 is a side view of the custom board (31) and custom robot (30) while being temporarily held down in a white water swirl after a knock down showing the recovery balloon (50) inflated just before the recovery balloon(50) rights the board(30) and robot(30). The recovery balloon (50) is tethered to the robot's (30) upper leg (not shown) as well as to the board's (31) deck (45). Once the custom board and custom robot are upright, the power is applied so the custom board (30) and custom robot(30) move forward and the balloon (50) is deflated. This balloon recovery system offers the quickest most effective method of recovery. It is worth pointing out that the receiving antenna (112) runs through the board, then up the robot's hollow leg, and peers out the robot's head.

Figure 20:
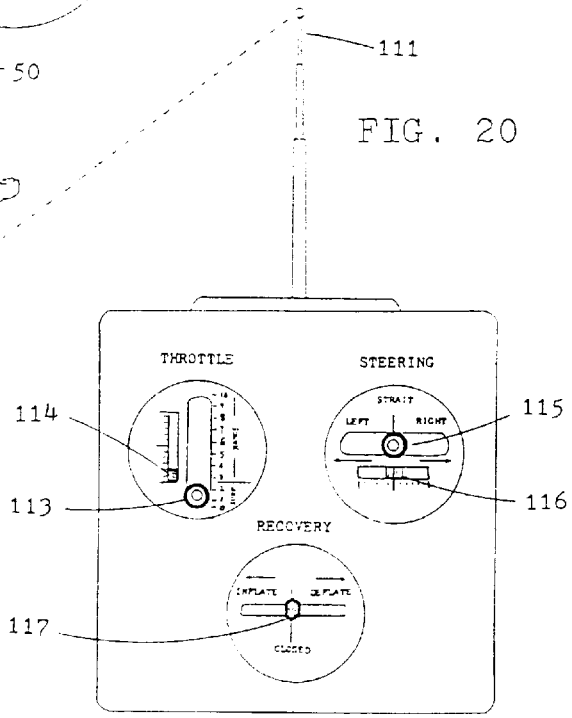
FIG. 20 Is a face view of the radio control box sending signals

FIG. 20 shows the control box with the recovery switch (117), a throttle with a throttle toggle switch (113) having both a range position and a surfing position and a fine idle adjustment (114). Also the control box has a steering mechanism with a steering toggle switch (115) and a fine centering adjustment (116).

Figure 21:
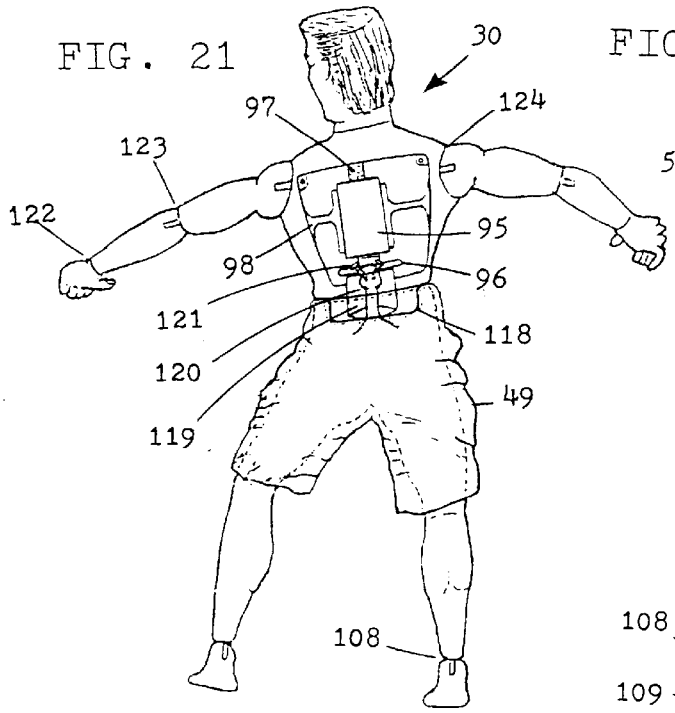
FIG. 21 Is a cutaway back view of the custom robot.

FIG. 21 is a cutaway back view of the custom robot (30) with the torso servo cover (51) removed. The waterproof micro servo (95), the servo torrent (96), the servo back brace (98) and the foam wedge (97) which are revealed. The foam wedge (97) allows the servo to be taken out for service and then put back in. The servo torrent fasteners (121) screw into the snap fit base arbor (120) and then pultrudes from the lower body. That snaps into the top of the snap-fit waist cylinder (119) which is part of the upper body. This all rotates in the rotating waist joint (118). All these components allow the waterproof micro servo (95) to push against the robot's back and rotate in sync with the other steering components. Also shown is the robot's surf trunks (49) and a rear view of all the moveable joints on the custom robot (30). The rotating jackknife ankle joints (108) provide the ability to hover the upper body weight over one side of the board or the other and are the only two joints not offered on the Mass Market Design. The upper body joints are also shown including the rotating wrist joints (122), the rotating jackknife elbow joints (123), and the rotating jackknife shoulder joints (124). The rotating jackknife joints rotate, as well as, pivot forward and back. The other rotating joints just rotate. These upper body joints are moveable, but made to hold position due to the tight tolerances molded into the joint parts. Thereby allowing the operator to place the robot in different desired styles for fun and different turning sensations. The waist joint (118) and ankle joint (108) are molded in loose tolerances to facilitate ease of movement. The custom robot's (30) entire body is filled with a lightweight foam except where the micro servo is located in the robot's back in order to float the robot and hold the surfboard hull on its side.

Figure 22:
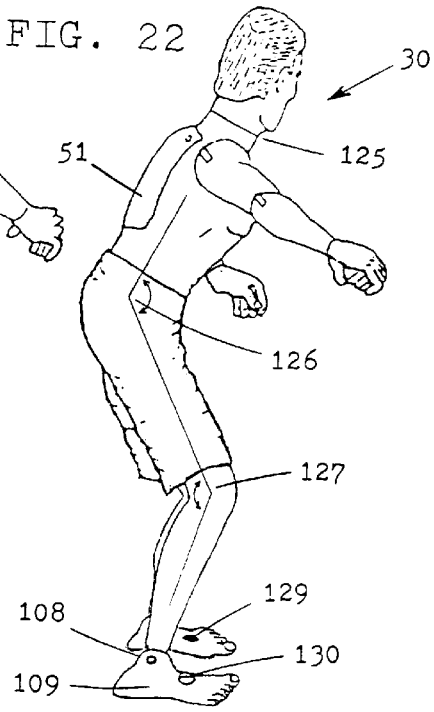
FIG. 22 Is a side view of the custom robot.

FIG. 22 shows the side view of the custom robot (30). It shows the molded angles of the pelvis (126) and knees (127) which hold the robot in such a way so that the upper body weight is centered over the ankles, therefore centered over the board's width. The molded pelvis (126) should be set at a fifty-two degree angle. The molded knees (127) should be at a forty-five degree angle. The rotating neck joint (125) is also shown. It also shows the torso servo cover (51) attached and a side view of the rotating jackknife ankle joint (108) and the robot's rear foot (109) and the rear foot fastening hole (129).

Figure 23:
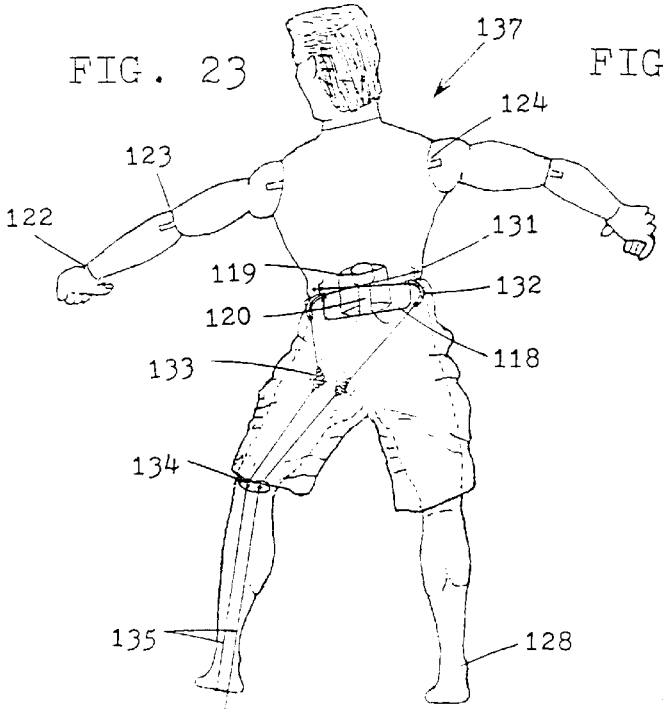
FIG. 23 Is a cutaway back view of the mass market robot.

FIG. 23 is a cutaway back view of the mass market robot (137). The mass market robot (137) has all the same upper body joints as the custom robot (30) and the same rotating waist joint design as the custom robot (30), but does not have the same ankle design or upper body movement mechanisms. The upper body of the mass market robot (137) is rotated by torso movement strings (135) pulled by a servo (140) inside the hull (103). The torso movement strings (135) move up the inside front leg through a guide (134) and then poke outside the body under the buttocks through the waterproof exits and guides (133) and then pass through the guide tubes (132) then finally to the string seats (131). These string seats (131) which are knotted at the end allow the operator to undo the strings from the seats easily to make inspection of the inside of the surfboard hull (103) without undoing the whole string-pulley system whenever the operator wants to remove the waterproof deck (45). It is preferable to fill the inside of the mass market robot's upper torso, head and arms with a lightweight foam in order to prevent its hollow body from filling with water and sinking when knocked over in the water. The lightweight foam will cause the robot to float in the water and hold the surfboard on its side so it can use the incoming waves to right itself as outlined in FIG. 9A.

Figure 24:
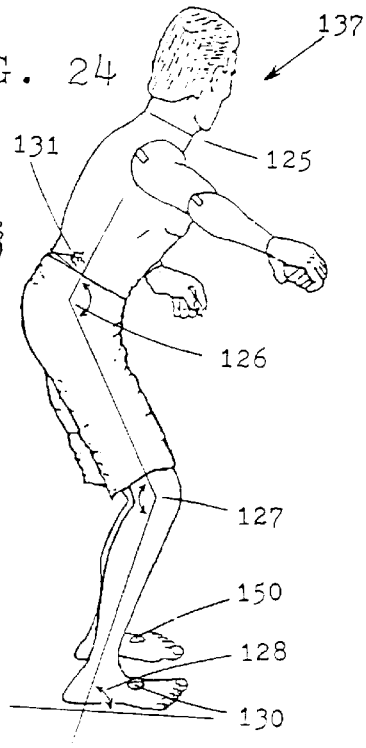
FIG. 24 Is a side view of the mass market robot.

FIG. 24 is a side view of the mass market robot (137). It shows the same molded angles at the pelvis (126) and knees (127) as the custom robot (30). Instead of moveable joint at the ankle, the mass market robot (137) has a seventy-four degree molded ankle (128) which centers the robot over the board. Also shown are the front (150) and rear (130) fastening bolts and a side view of a string seat (131).

FIG. 25 is a right side cut away view of the mass market board (148) and mass market robot (137). There are no mechanisms above deck or between the robot's legs because the fifty torque standard servo (140) is placed sideways inside the board's hull (103) instead of sticking halfway out of the deck like the custom board (31). This standard servo (40) runs two steering movements, the steering nozzle (68) and the body movement number two. The steering nozzle (68)is moved by a bent push-rod exit (149). Body movement number two is a torso twisting movement and the same movement as on the custom robot (30) but is run by strings coming from the standard servo (140) instead of back mounted micro servo (95). These strings are run from the robot's leg into the string guide (134) in the deck through the heel of the mass market robot (137) and are caulked in order to waterproof the entry area. The strings pass through the left (145) and right (144) turn pulleys attached to the pulley post (146) then to the asymmetrical servo arm (139) run by the standard servo (140). Other than the aforementioned 2-way steering system, the mass market board (148) and mass market robot (137) share many of the same components as the custom board (31) and custom robot (30).

FIG. 26 shows the mass market board (148) and mass market robot (137) in a full extension right-hand turn at a sixty-five degree angle to the waterline (154). This drawing shows the less radical but efficient turning capabilities of the mass market board (148) and mass market robot (137). It also shows an end view of the bent push-rod (138) exiting through the waterproof exit (149).

FIG. 27 shows the underside of the waterproof deck (45) of the Mass Market Design. It shows the compression cuff (100) the front (147) and rear (105) foot blind nuts as well as the torso movement strings (135) coming through the string guide (134). It is noticeable in this drawing that this waterproof deck(45) is a lot less complicated with fewer components than the Custom Design board's deck.

FIG. 28 shows top view of the mass market board (137) with the waterproof deck (45) shown detached. It is noticeable that there are fewer components and more vacant space inside the Mass Market Design.

DETAILED DESCRIPTION OF THE INVENTION—OPERATION OF THE INVENTION

Figure 14:
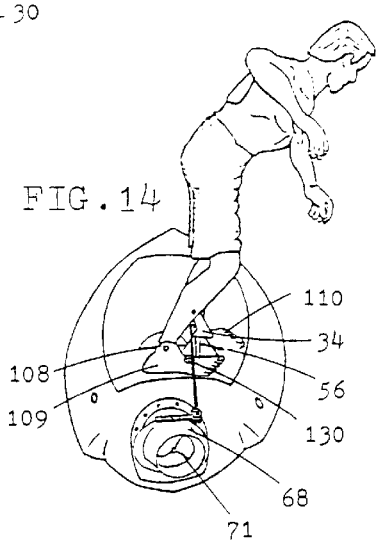
FIG. 14 Is an elevated end view of the custom surfboard and robot in the full extension right-hand turn position.
Figure 15:
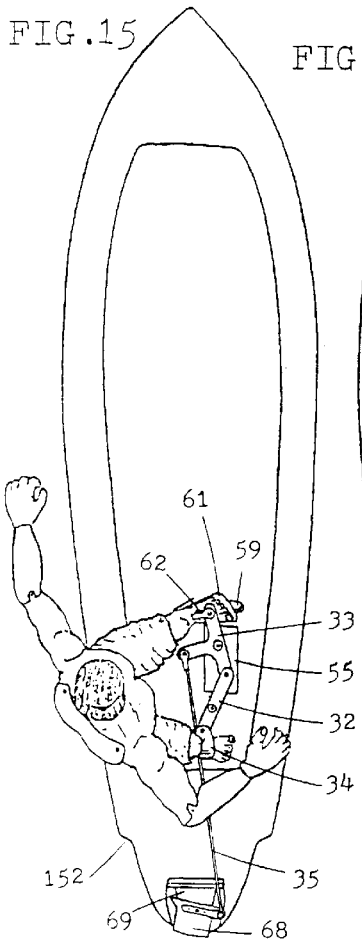
FIG. 15 Is a top view of the custom surfboard and robot in the full extension left-hand turn position.
Figure 16:
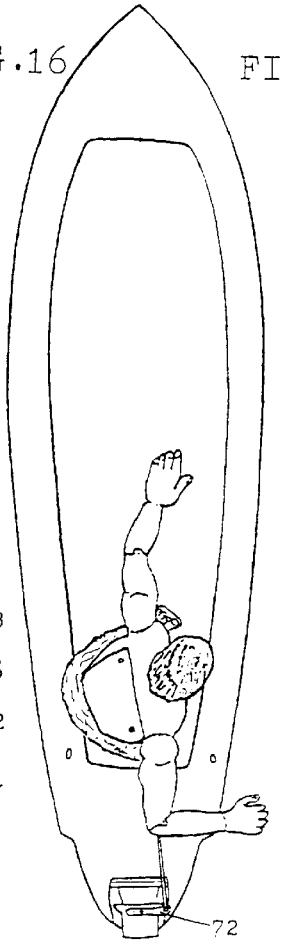
FIG. 16 Is a top view of the custom surfboard and robot in the center balanced go-strait position.
Figure 17:
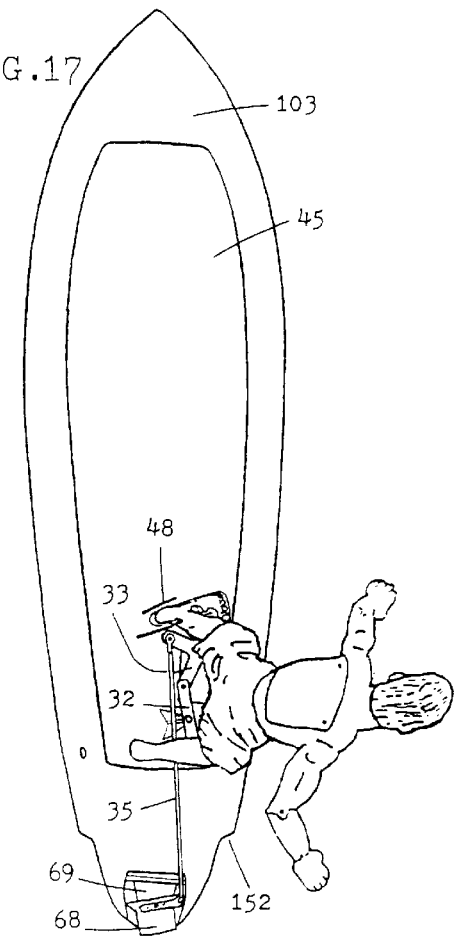
FIG. 17 Is a top view of the custom surfboard and robot in the full extension right-hand turn position.

FIGS. 12, 14, 15, and 17 show the robot's body movement number one which is the most effective of three available body movements. Body movement number one leans the robot's whole body and weight over one side of the board or the other. Body movement number one is shown by the robot's whole body hovering over the right side of the board. The lean stand (34) is shown pulling the robots rear leg over by the pivoting action provided by the robot's rotating jackknife ankle joint (108). FIG. 17 shows the top view of this movement number one. The 3-way servo arm (33) moves the flexible reversing arm (32) in a scissor-like manner. FIG. 15 clearly shows the servo arm (33) and the reversing arm (32) which pushes the robot's weight over the left side of the board. It also shows the primary waterproof servo (55) that drives the body movement's of body movement number one and body movement number three as well as the steering nozzle (68). FIG. 15, also shows the reversing arm (32) connected to the lean stand (34), as well as, the push rod (35) extending from the 3-way servo arm (33) which moves the steering nozzle (68). In addition, FIG. 15 shows a top view with the exposed foot travel groove (59) due top the front foot (10) being pushed backwards in the left-hand turning position. The 2-way connector (62) and the slide plate (61) are also visible. FIGS. 12 thru 17 show the custom robot's (30) body movements and the steering nozzle (68) being pushed and pulled in synchronized movements by the connected parts.

FIGS. 12, 14, 15, and 17 show the robot's body movement number two which is the second most effective of the three. The body movement number two rotates the upper body in the direction of the turn swinging the leading arm way over either side of the board. Body movement number two is noticeable by the different positions of the robots leading arm and upper body [shown in FIGS. 12 and 14]. The robot's leading arm is placed well over the right side of the board and the chest is noticeable [FIG. 14]. The robot's leading arm is rotated backward over the left side of the board and the back is noticeable as well as the torso servo cover (51) [FIG. 12].

FIGS. 14, 15, and 17 show the robot's body movement number three which is the third most effective of the three. It moves the front foot from one side of the board to the other. This movement helps to place additional weight over one side of the board or the other.

FIGS. 12, 14, 15, 17 shows the components that drive and move the robot's body. For example, the custom robot (30) is shown in a full extension right-hand turn in FIG. 14 where body movement number three is evidenced by the front foot (110) extended out to the right side of the board. This is also shown in the top view of FIG. 17 which shows the heel guides (48). The heel guides(48) steer the robot's heel on the back-stroke to prevent the custom blind nut and guide (60) from catching and binding. It is important to note that the upper body position shows the robot's leading arm is placed almost straight out and slightly down, in contrast, the trailing arm is bent inwards, close to the body. This makes the leading arm and hand have a large effect on turning and leaning the board over. And the trailing arm gives a neutral effect. It would be desirable to have the leading hand molded out of a heavy metal, like lead or steel. This would add more power to the rebounding capabilities of the steering mechanism.

SUMMARY, SCOPE, AND RAMIFICATIONS

It is not necessary for the invention to work to have a robot figurine. A rigid figurine can be attached to the surfboard and controlled only by the steering nozzle. However, for the best moving ability, the robot as disclosed is the best mode of this invention.

The Mass Market Design was made because of the cost factor. The Custom Design is an intricate component-laden vehicle. It uses two micro servos. One of which is waterproof and one 70-torque primary servo which is also waterproof Micro servos are very expensive and so are waterproof servos. These three servos alone add high cost to the vehicle. Additionally, the recovery system and a three-channel radio both increase the cost of the Custom Design. In comparison, the Mass Market Design uses one fifty-torque standard servo and has a less expensive two-channel radio.

The Custom Design can do more maneuvers, turn tighter, recover faster from wipe-outs, and show more realistic surfing action, however, the cost of producing it would limit sales to a speciality market only. The high cost of the Custom Design board lead to the design of the Mass Market Design. The Mass Market Design board has a means of knock down recovery and can also range, catch a wave, and ride waves good enough to give the operator hours of fun and excitement. It still operates as an unprecedented surfing toy at a price that will allow it to sell into the millions. The decreased cost leads to a difference in performance. The mass market design board cannot achieve the tight radius turning as the custom board is capable of performing (as seen while comparing FIGS. 18 and 26).

Through testing it was learned that only an expert controller could surf waves with the power off completely. Later, it was found that riding waves at 10 to 20% throttle offered incredible control. Enabling the operator to cut loose and maneuver at will, riding wave after wave without knock downs on a consistent basis. This again is because of the suction hole sucking the planing surface of the surfboard to the water's surface. This is in addition to surface tension which occurs naturally. Therefore, the surf mode was developed and designated on a control box's throttle switch.

The custom design surfboard includes a balloon recovery system which is shown in the drawings. The hull of the surfboard can accommodate more tanks than shown. In increased number of tanks will allow for an increase number of balloon refills. It is known that enough tanks may be added to allow for about ten refills of the balloon system.

What is claimed is:

1. A radio controlled steerable self-propelled surfing toy capable of moving on water comprised of:

an erect figurine pivotally attached to a surfboard;

a jet propelled surf board having a hull with sufficient buoyancy to keep the surfboard afloat on water, and having a general longitudinal axis, said surfboard having an upper surface said upper surface being the place of attachment of said figurine;

a variable speed motor enclosed in said hull;

a power source operatively connected to the motor;

a control means operatively connected to a power source and motor for continuously and differentially varying, at an operator's control, any level of power supplied from the power source to the motor; and wherein the control means further includes a steering system configured to control the movement of the surfboard by pivotal movement of the figurine relative to the surfboard.

2. A surfing toy according to claim 1 wherein said figurine is multi-jointed and moveable.

3. A surfing toy according to claim 1 wherein said figurine is hollow and filled with a lightweight flotation substance.

4. A surfing toy according to claim 1 wherein the control means includes a control box adapted to be hand held remote from the surfboard.

5. A surfing toy according to claim 1 wherein the control means comprise radio signal transmitting means adapted to be hand held and manipulated by the operator at a remote location from the surfboard, and a signal receiving means incorporated in the surfboard and operatively associated with the power source and with the motor, the signal transmitting means emitting command signals and the signal receiving means receiving the command signal and applying power to the motor in substantial conformance to the command signals.

6. A surfing toy according to claim 5 wherein the steering system configured to rotate the figurine's upper body in the same turning direction as the surfboard and configured to swing an arm of the figurine.

7. A surfing toy according to claim 5 wherein the steering system that is configured to control the movements of the figurine's body in three ways, first, the figurine's whole body can move so the weight is on one side of the board or the other due to a first servo at the base of the figurine's foot, second, the figurine's upper body can rotate to move in the same turning direction as the surfboard while also swinging an arm due to a second servo in the figurine's back, third, one of the figurine's feet can move from one side of the board to the other due to the first servo at the base of the figurine's feet.

8. A surfing toy according to claim 1 having a wave action recovery system that rights said surfing toy by the particular positioning of the batteries within the hull of the surfboard as close to the hull's exterior walls.

9. A surfing toy according to claim 5 wherein said surfing toy is capable of fielding waves, catching waves, then riding a left breaking or right breaking wave on the crest of a wave or the face of a wave in simulation of a human surfer due to the first and second servos and the remote control.

10. A surfing toy according to claim 5 wherein said surfing toy's turns on waves, controlled by the first and second servos, are assisted by the weight of the figurine's body.

11. A surfing toy according to claim 1 having a jet-propulsion system with an opening ranging between 7% and 14% of the entire bottom surface of the underside of the surfboard which allows for suction of the hull to the water's surface.

12. A surfing toy according to claim 1 wherein said surfboard further comprises at least one stabilizing break away fin projecting downwardly.

13. A surfing toy according to claim 1 having a steering nozzle directing a shooting flow of water.

14. A surfing toy according to claim 1 having a remote controlled balloon recovery system that rights said surfboard and figurine after falling over.

15. A surfing toy according to claim 1 having a detachable waterproof deck having a fitted panel fitting flush to said surfboard's upper surface shape and said deck is fastened with only one pivoting deck clamp.

16. A radio controlled steerable self-propelled surfing toy capable of moving on water comprised of:

an erect figurine pivotally attached to a surfboard;

a jet propelled surf board having a hull with sufficient buoyancy to keep the surfboard afloat on water, and having a general longitudinal axis, said surfboard having an upper surface said upper surface being the place of attachment of said figurine and wherein said hull's widest point is forward of the figurine providing a constant point of control;

a variable speed motor enclosed in said hull;

a power source operatively connected to the motor, a control means operatively connected to the power source and motor for continuously and differentially varying, at an operator's control, any level of power supplied from the power source to the motor; and wherein the control means further includes a steering system configured to control the movement of the surfboard by pivotal movement of the figurine relative to the surfboard.

17. A surfing toy according to claim 16 wherein said surfboard portion has a planing bottom surface with an opening that ranges between 7% and 14% of the entire bottom of the surfboard and ranges between 20% and 30% of the wetted bottom surface of the surfboard when in water and said planing bottom surface is generally convex transversely extending between a nose and a tail.

18. A surfing toy according to claim 16 wherein said surfboard portion has a rounded winged pin tail to provide space for a jet propulsion system components, including the motor.

* * * * *